US007384310B2

(12) United States Patent
Hu et al.

(10) Patent No.: US 7,384,310 B2
(45) Date of Patent: Jun. 10, 2008

(54) ELECTRICAL CONNECTOR WITH RELIABLE STRUCTURE AND METHOD FOR MAKING THE SAME

(75) Inventors: Jun-Hua Hu, Kunshan (CN); Qing Wan, Kunshan (CN); Li-Chun Wu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/708,859

(22) Filed: Feb. 20, 2007

(65) Prior Publication Data

US 2007/0197073 A1 Aug. 23, 2007

(30) Foreign Application Priority Data

Feb. 18, 2006 (CN) ..... 2006 1 0038429

(51) Int. Cl.
*H01R 13/648* (2006.01)

(52) U.S. Cl. ..... 439/607; 439/541.5; 439/108

(58) Field of Classification Search ..... 439/67, 439/541.5, 79, 80, 108, 607, 891, 890, 830, 439/843

See application file for complete search history.

(56) References Cited

U.S. PATENT DOCUMENTS 5,167,531 A 12/1992 Broschard
6,508,665 B1 1/2003 Yeh
6,835,092 B2 * 12/2004 Wan et al. ..... 439/541.5

* cited by examiner

*Primary Examiner*—Renee Luebke
*Assistant Examiner*—Harshad C Patel
(74) *Attorney, Agent, or Firm*—Wei Te Chung

(57) ABSTRACT

An electrical connector (100) mounted on an outer PCB for mating with corresponding plugs includes an insulative housing (1), a couple of contact modules (3) and a metal shield (2) enclosing the insulative housing. The housing includes a first plug-receiving cavity (101) and a second plug-receiving cavity (102) stacked under the first cavity (101). The contact modules (3) include a number of conductive contacts (33) defining a plurality of inclined contact portions (331) extending into the cavities (101, 102). The metal shield includes a planar top face (21), a pair of side face (22) integrally extending downward from the lateral edges of the top face, and a slant rear face (23) integrally bending from the side face. A lower edge of said side face is larger than an upper edge of the side face in a plug insertion direction.

20 Claims, 13 Drawing Sheets

ELECTRICAL CONNECTOR WITH RELIABLE STRUCTURE AND METHOD FOR MAKING THE SAME

BACKGROUND OF THE INVENTION

1. Field of the Invention

The present invention relates to an electrical connector and a method thereof, and more particularly, to an electrical connector mounted on a printed circuit board (PCB) for mating with a corresponding plug and a method for making such an electrical connector.

2. Description of the Prior Art

U.S. Pat. No. 6,910,917 B2 issued to Chen on Jun. 28, 2005 discloses a conventional electrical connector mounted on a printed circuit board. The conventional electrical connector has a first connector, a second connector stacked vertically below the first connector, and an integral metal shield covering the first and second connectors. The electrical connector has a relatively large height and small width. With insertion of a first plug into the first connector on the upper level, the electrical connector trends to be overturned, thereby affecting the performance of signal transmission.

Hence, an improved electrical connector with reliable structure and method thereof are needed to overcome the disadvantages above.

BRIEF SUMMARY OF THE INVENTION

An object of the present invention is to provide an electrical connector with reliable configuration mounted on a PCB for mating with a corresponding plug.

Another object of the present invention is to provide a method for making such an electrical connector.

In order to attain the object above, an electrical connector mounted on an outer PCB for mating with corresponding plugs, comprises an insulative housing, a pair of contact modules received in the housing, an internal PCB, a couple of anti-mismating devices, a connecting module, a grounding member and a metal shield enclosing the housing. The housing includes a first plug-receiving cavity and a second plug-receiving cavity stacked under the first cavity. The contact modules include a plurality of conductive contacts having a plurality of inclined contact portions extending into the first and second cavities for mating with the plugs. The metal shield is stamped and bent from a metal sheet. The metal shield includes a planar top face, a pair of side face integrally extending downward from the lateral edges of the top face, and a slant rear face integrally bending from the side face. Each side face is trapezia shaped wherein a lower edge of the side face is larger than an upper edge of the side face in a plug insertion direction. With this arrangement, the electrical connector has a steady structure for mating with corresponding plugs. Moreover, in manufacture, the use rate of the metal sheet is improved, thereby saving the cost of manufacture.

DETAILED DESCRIPTION OF THE INVENTION

Figure 1:
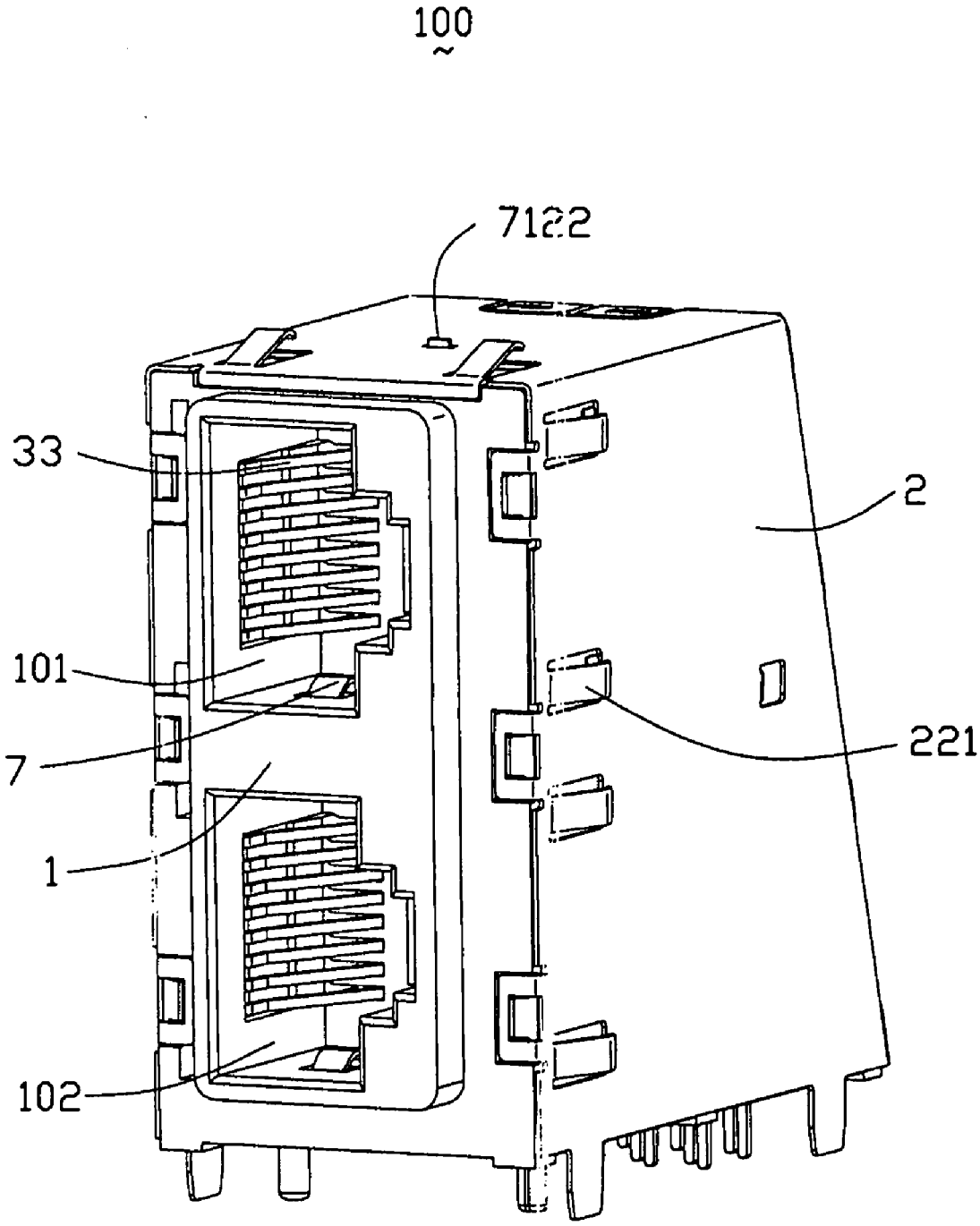
FIG. 1 is a perspective view of an electrical connector according to the present invention.
Figure 2:
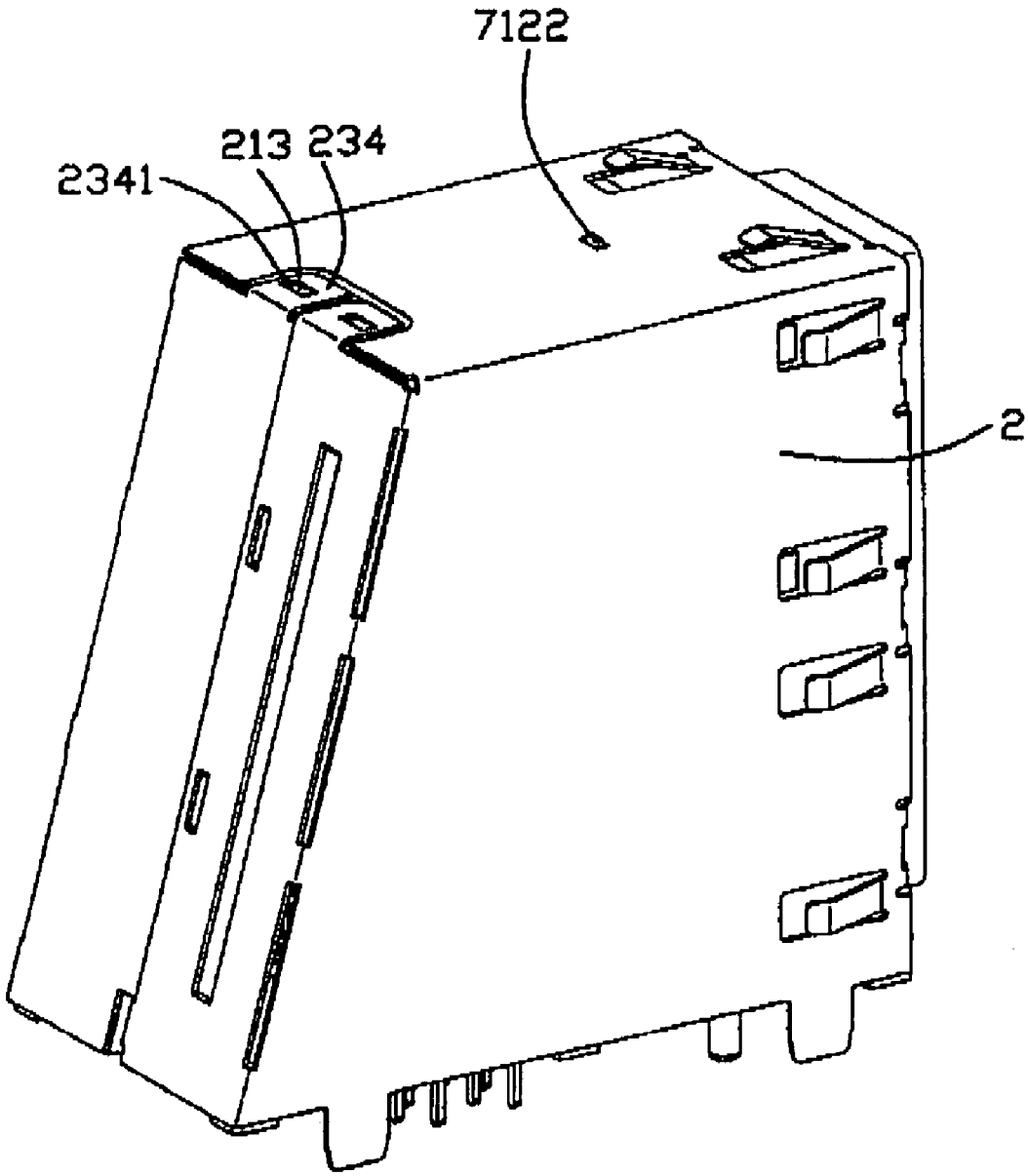
FIG. 2 is another perspective view of FIG. 1.
Figure 3:
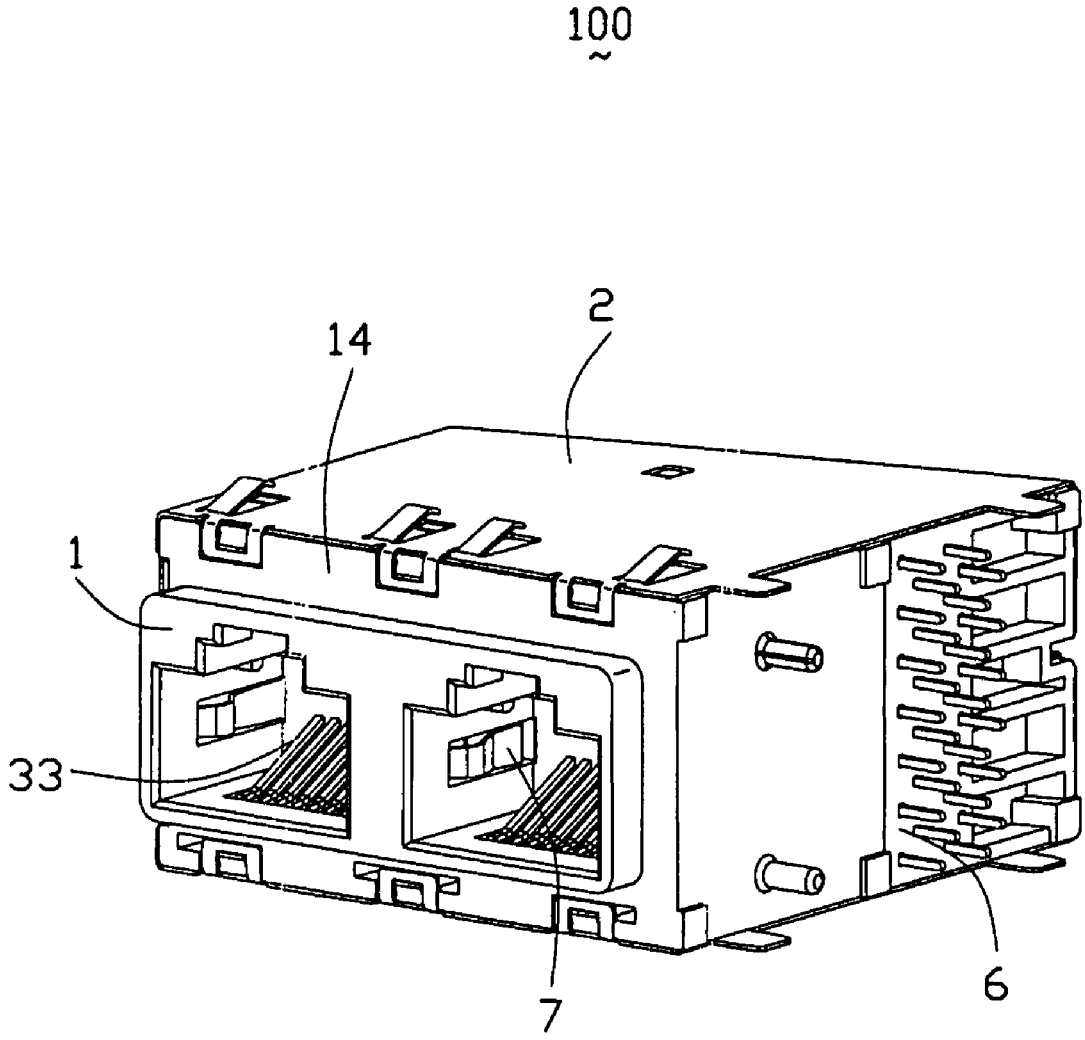
FIG. 3 is a further perspective view of FIG. 1.

Referring to FIGS. 1-6, an electrical connector 100 mounted on an outer PCB (not shown) for mating with corresponding plugs (not shown) comprises an insulative housing 1, a pair of contact modules 3 received in the housing 1, an internal PCB 4, a couple of anti-mismating devices 5, a connecting module 6, a grounding member 7 and a metal shield 2 enclosing the housing 1. The electrical connector 100 of the preferred embodiment is a stacked modular jack connector 100 for mating with two modular plugs. However, it is noted that the present invention can be applied to connector interface other than modular jack connector interface, such as USB type, IEEE-1394 type etc.

The insulative housing 1 comprises a top wall 11, a pair of side walls 12, a bottom wall 13 opposite to the top wall 11, a mating wall 14 and a rear wall 15 opposite to the mating wall 14. The mating wall 14 defines a first plug-receiving cavity 101 and a second plug-receiving cavity 102 stacked under the first plug-receiving cavity 101. As the embodiment illustrated, the first and second cavities 101, 102 are adapted for receiving the RJ type connectors. The bottom wall 13 includes an extending portion 131 horizontally projecting rearward wherein the extending portion 131 defines a slot 132 at a distal end thereof for mating with the connecting module 6. The mating wall 14 further forms a plurality of embosses 141 for locking with the metal shield 2. The rear wall 15 includes an E-shaped retaining channel 151 and three depressions 152 perpendicularly extending inwardly from three distal ends of the retaining channel 151 respectively. The depressions 152 are in communication with the cavities 101, 102 for receiving the grounding member 7. A plurality of first and second positioning posts 153, 154 are set on the rear wall 15 along a height of the housing 1. The rear wall 15 further includes a plurality of receiving holes 157 inwardly between the first and second positioning posts 153, 154. The first positioning posts 153 are adapted for mating with the contact modules 3 and the second positioning posts 154 are adapted for fixing with the anti-mismating devices 5. The insulative housing 1 further defines a couple of first and second openings 155, 156 in communication with the first and second cavities 101, 102 respectively for receiving the contact modules 3 as described hereinafter.

Figure 4:
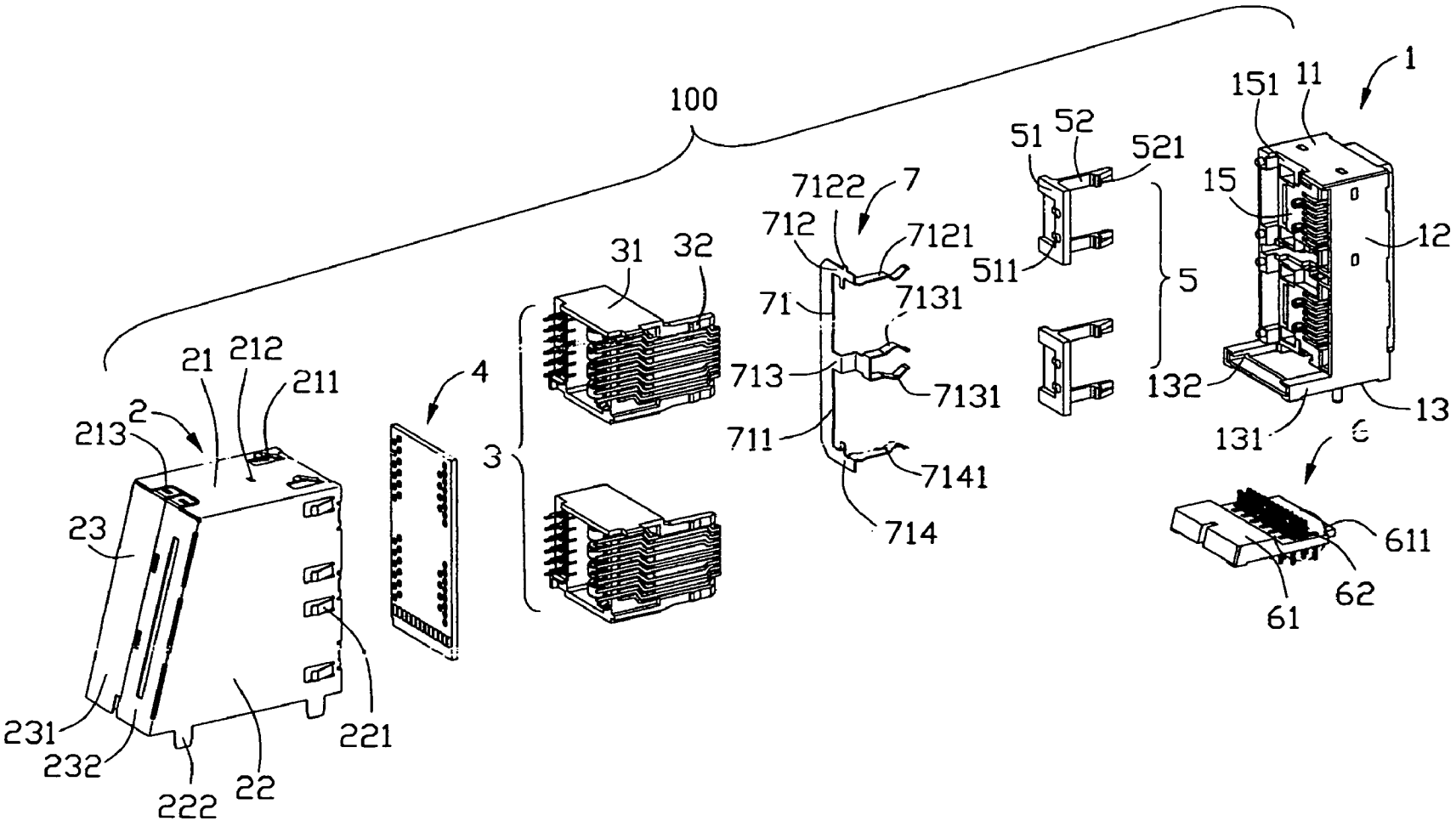
FIG. 4 is an explode view of the electrical connector of FIG. 1.
Figure 5:
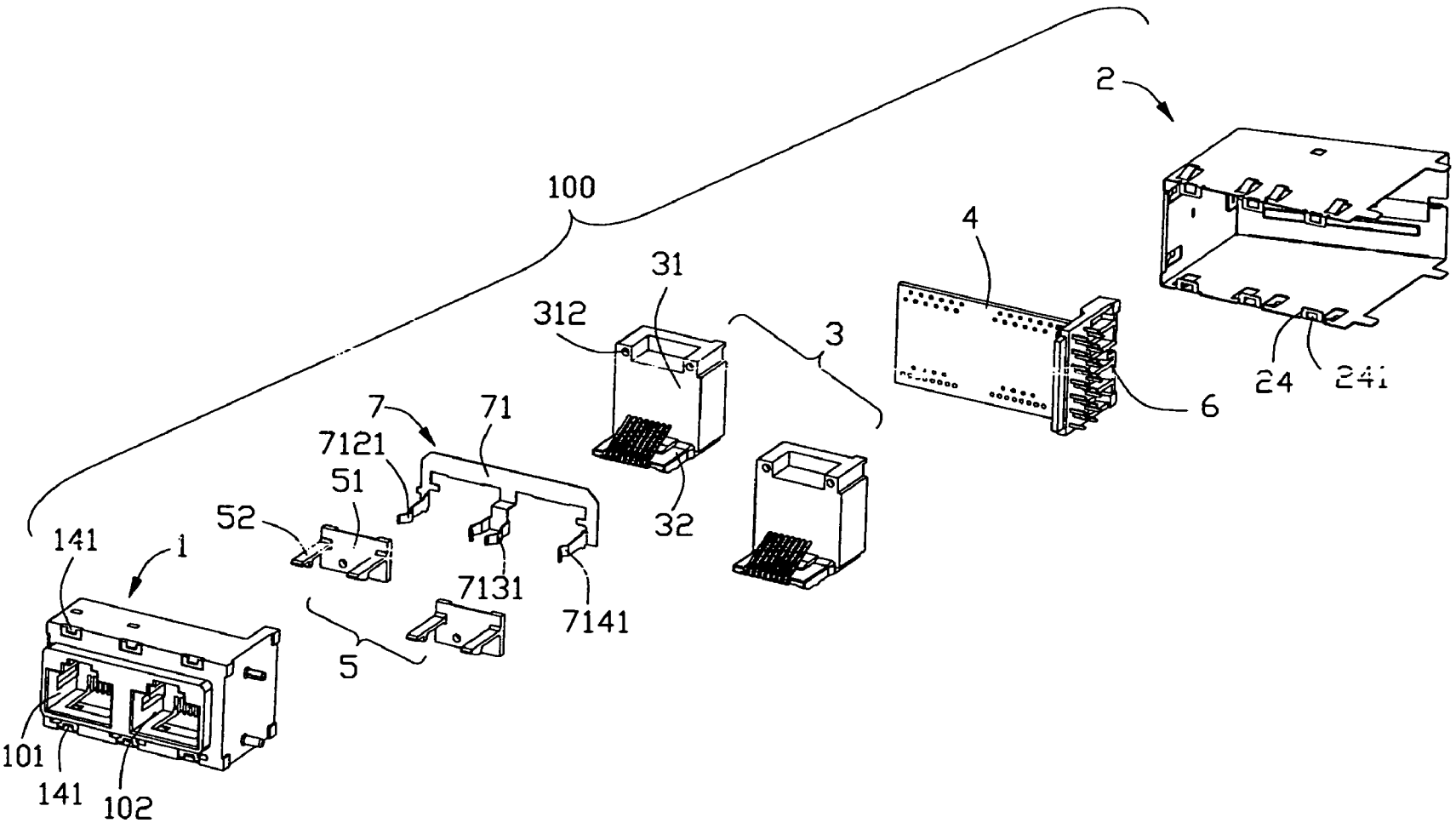
FIG. 5 is another explode view of FIG. 3.

Referring to FIGS. 4 and 5, the metal shield 2 is stamped and bent from a metal sheet and includes a planar top face 21, a pair of side face 22 extending downwardly from the lateral edges of the top face 21 and a rear face 23 integrally bending from two side face 22. The top face 21 forms a pair of first fingers 211 extending upwardly beyond the top face 21 in the front, an engaging hole 212 in the middle portion and a pair of tabs 213 in the back. Each side face 22 is right-angle trapezia shaped wherein a lower edge of the side face 22 is larger than an upper edge of the side face 22 in a plug insertion direction. The side face 22 includes a plurality of protrusions 24 bending from the front edge thereof, wherein each protrusion 24 comprises a hole 241 for fixing with the emboss 141 of the housing 1. Each side face 22 further includes a plurality of second fingers 221 and soldering tails 222 extending downwardly for being soldered to the outer PCB (not shown). The rear face 23 is disposed in slant configuration and includes a first portion 231 and a second portion 232. The first portion 231 includes a plurality of protrusions (not labeled) and the second portion 232 defines a plurality of dents (not labeled) for locking with the protrusions. The rear face 23 further forms a pair of projecting sections 234 each having an aperture 2341 for mating with the tabs 213. In manufacture, the waste part of the metal sheet is substantially between the first and second portion 231, 232, thereby enhancing the use rate of the metal sheet and saving cost of manufacture.

Figure 7:
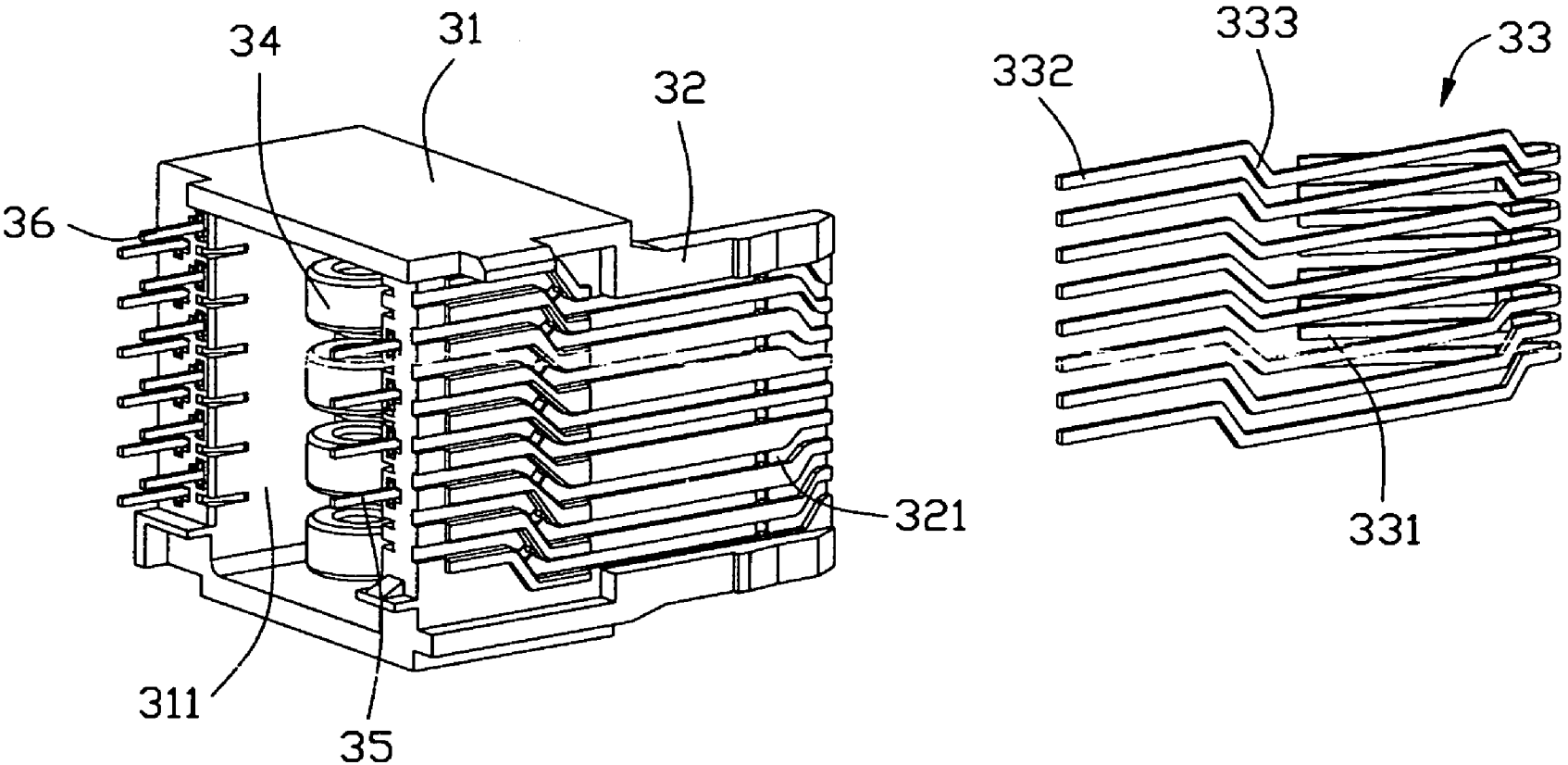
FIG. 7 is a partially assembled view of a contact module.

Referring to FIG. 7, the contact module 3 includes a base portion 31, a tongue 32 extending forwardly from the base portion 31, a plurality of conductive contacts 33 retained in the base portion 31, a plurality of magnetic coils 34 and a set of first and second transition terminals 35, 36. The first and second transition terminals 35, 36 together with the conductive contacts 33 electrically connects together through a function of the magnetic coils 34, which is well known for one of ordinarily skill person in the pertinent art, so a detail description thereabout is omitted herein. The base portion 31 defines a chamber 311 for receiving the magnetic coils 34 and a plurality of first mounting holes 312 for mating with the first positioning posts 153 (seen in FIG. 5). Each conductive contact 33 includes a retaining portion 333 secured in the passageways 321 of the tongue 32, a tail portion 332 and a contact portion 331 slanting from the retaining portion 333.

Figure 11:
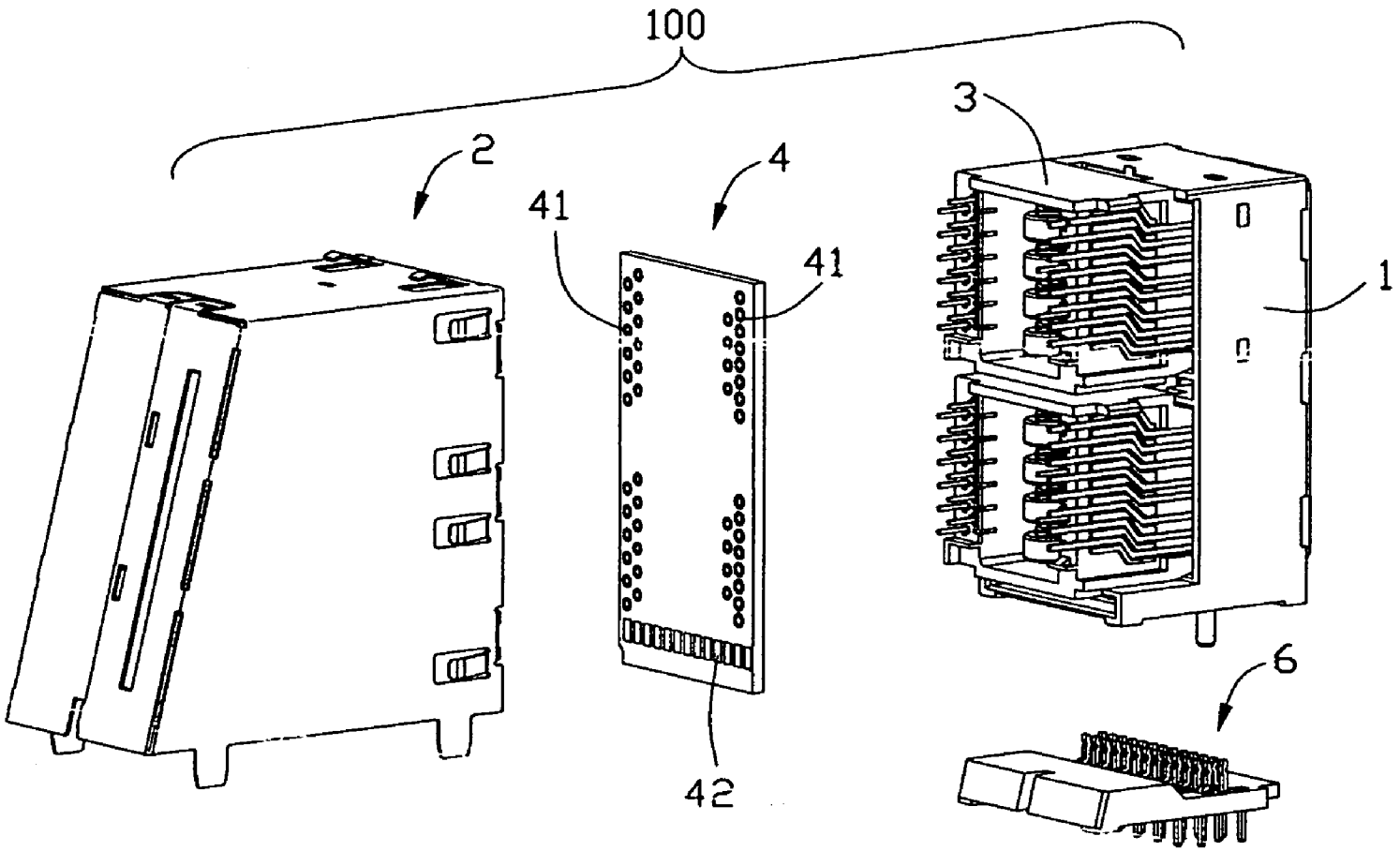
FIG. 11 is a partially assembled view of the electrical connector according to the present invention with assembly of the contact module.
Figure 12:
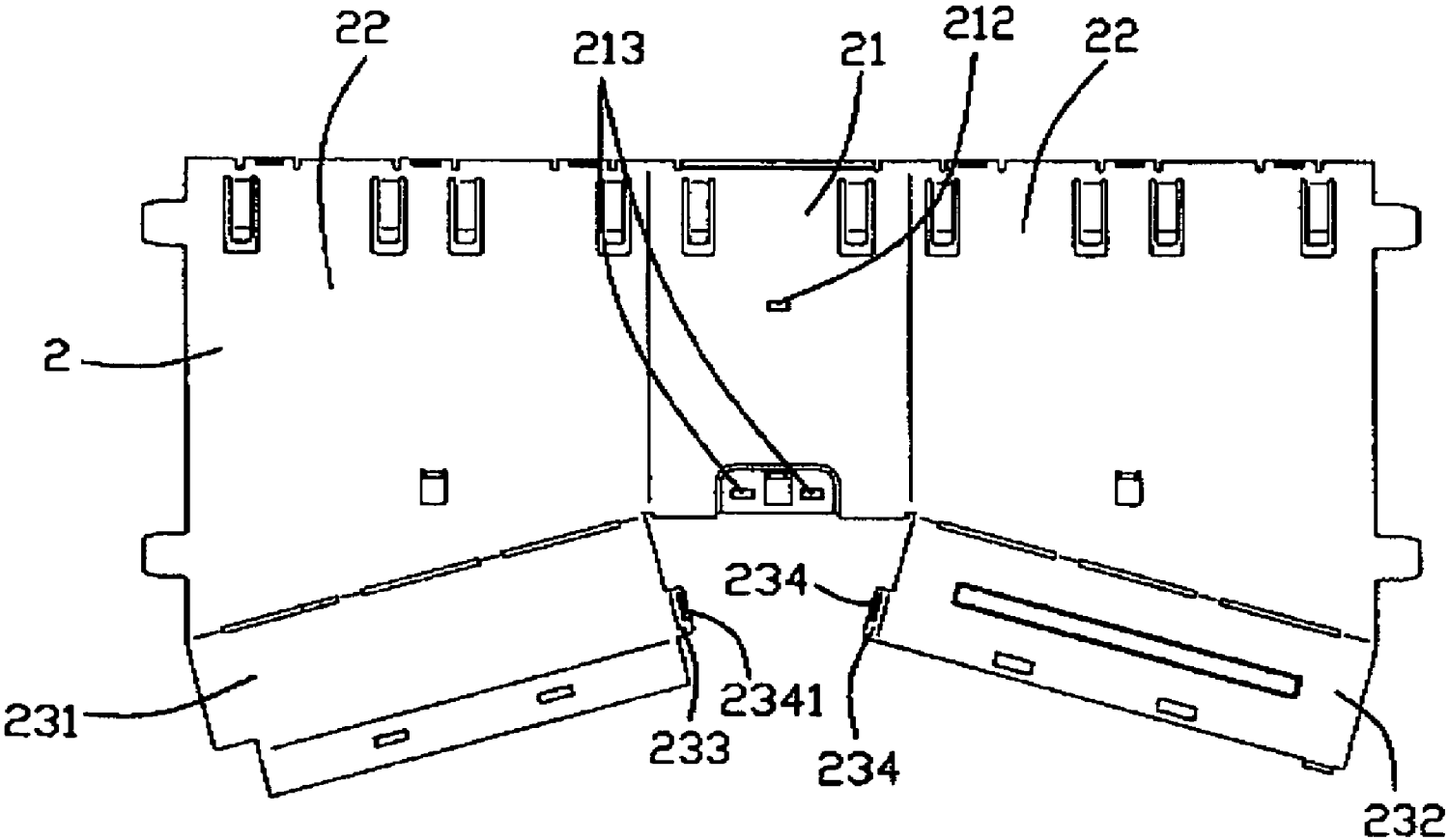
FIG. 12 is a plane view of a metal shield.

Referring to FIG. 11, the internal PCB 4 defines a plurality of circuit points 41 and electric pads 42 corresponding to the circuit points 41. A plurality of traces (not shown) are disposed on the internal PCB 4 for connecting the circuit points 41 and the electric pads 42.

Figure 6:
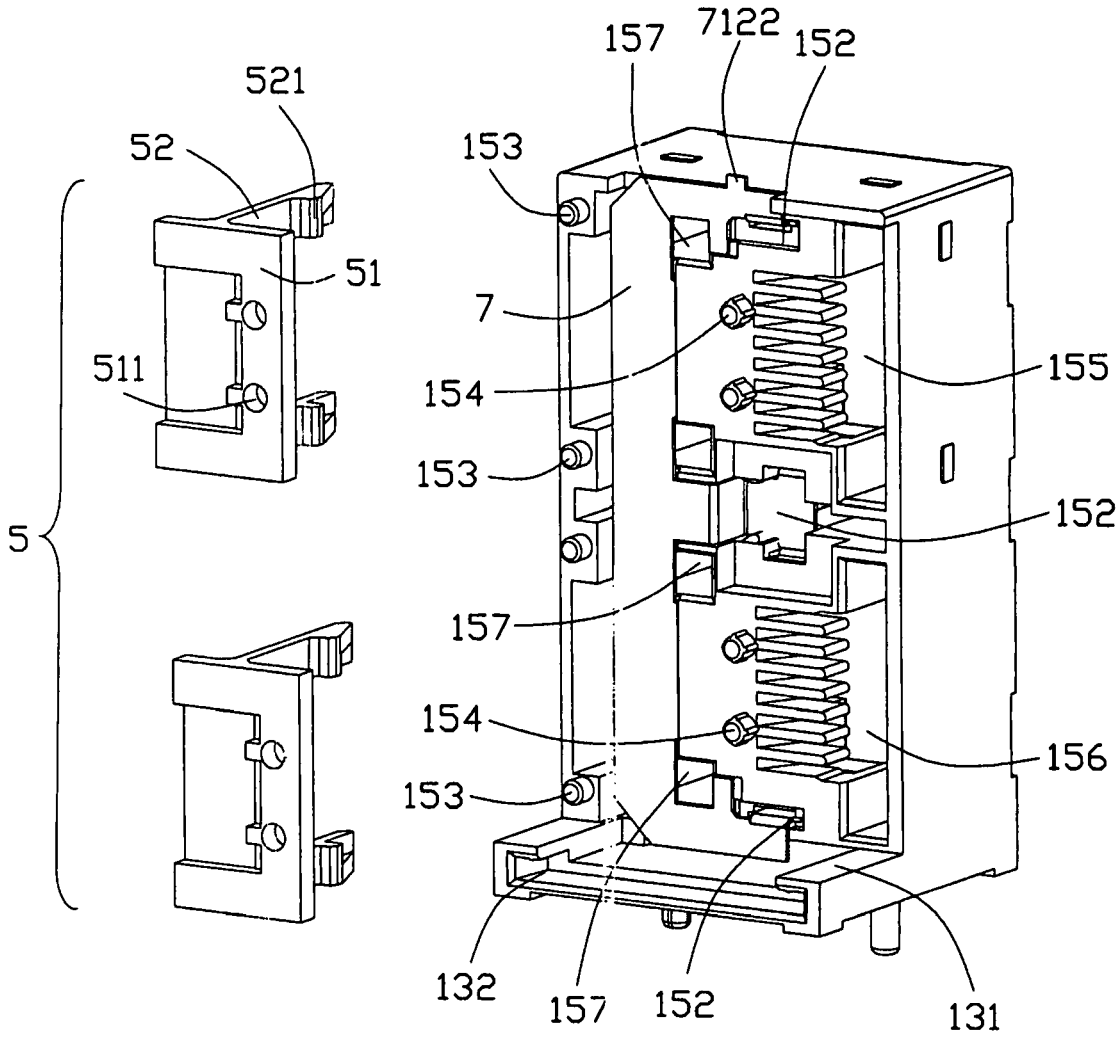
FIG. 6 is a partially assembled view showing a grounding member secured within an insulative housing.

Referring to FIG. 6, each anti-mismating device 5 comprises a vertical main body 51 and a pair of cantilevers 52 extending forward from the main body 51. The main body 51 defines a pair of second positioning holes 511 for mating with the second positioning posts 154. Each cantilever 52 includes a hook 521 disposed on a distal end wherein the cantilever 52 can be assembled through the receiving holes 157 into the cavities 101, 102 for preventing incorrect connectors from being inserted therein.

Figure 8:
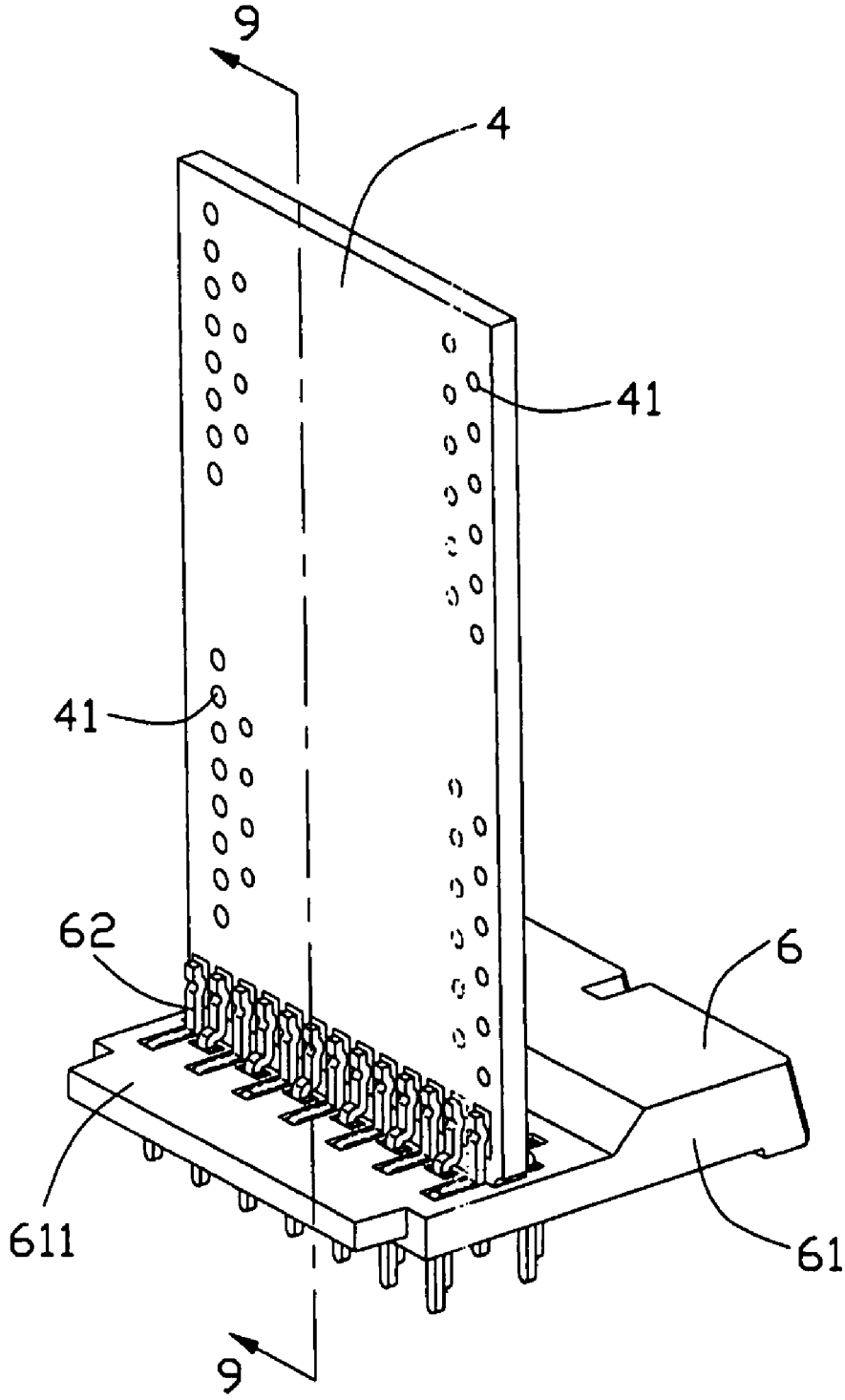
FIG. 8 is a partially assembled view showing an internal PCB mounted to a connecting module.
Figure 9:
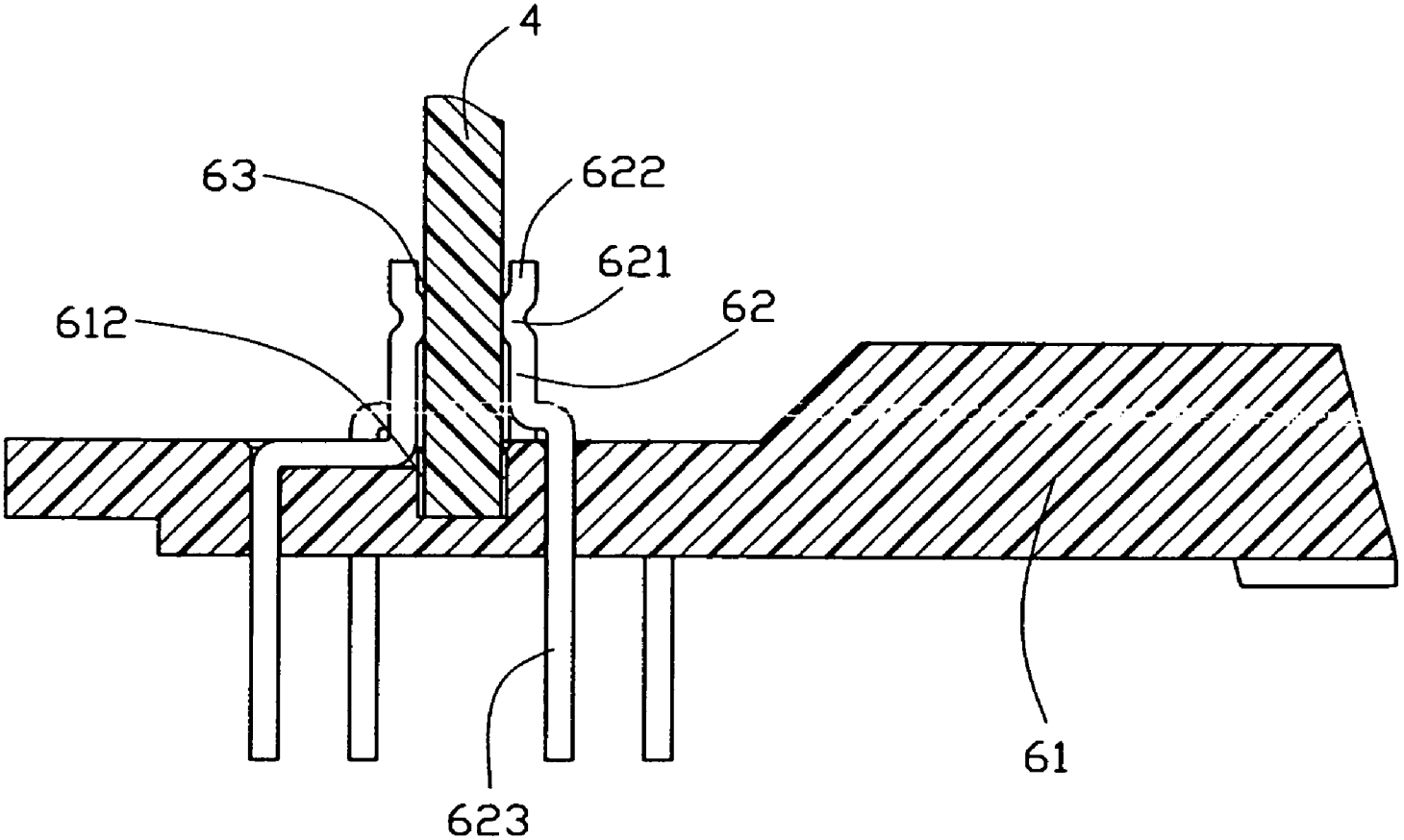
FIG. 9 is a cross sectional view taken along line 9-9 of FIG. 8.
Figure 10:
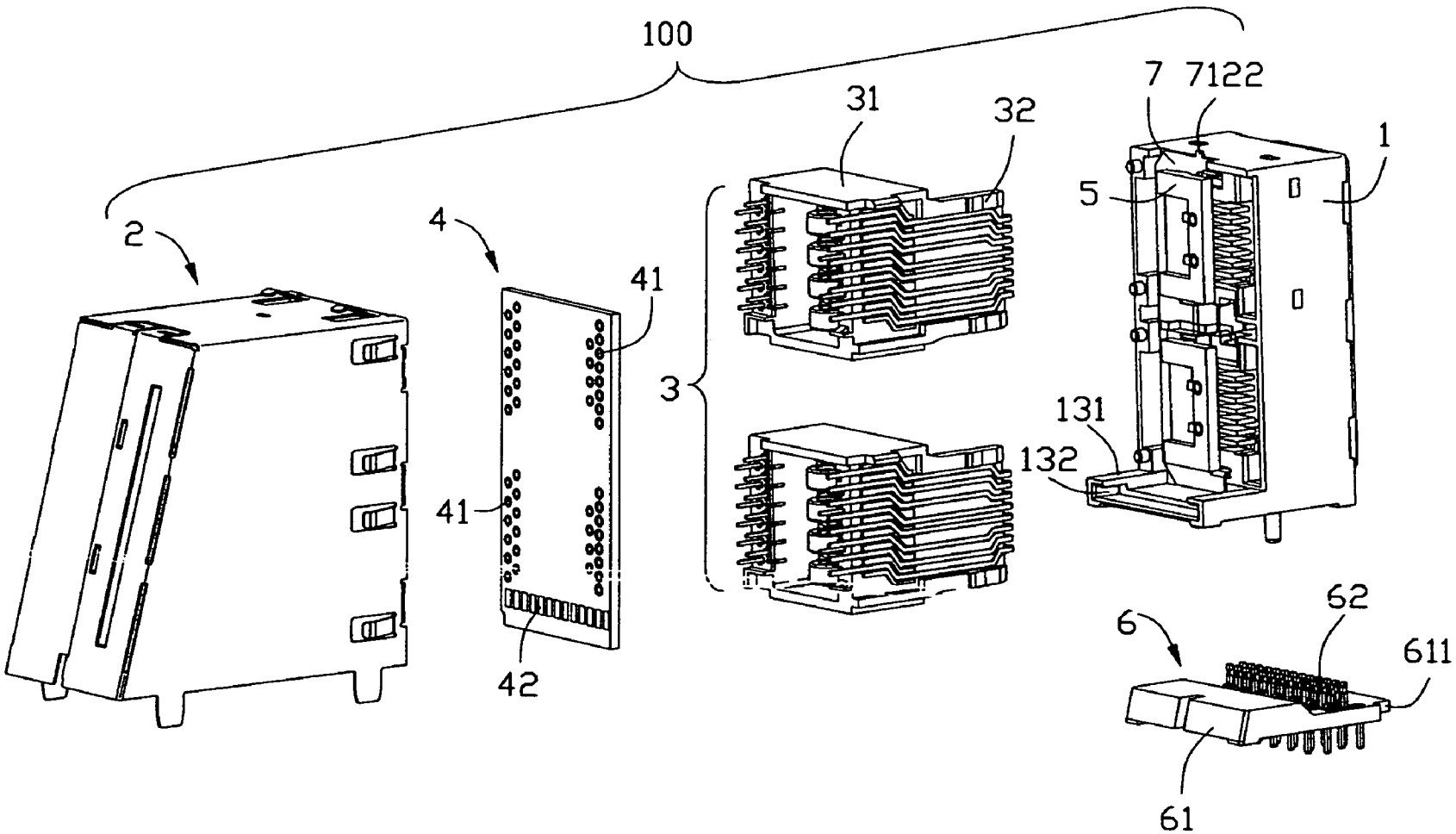
FIG. 10 is a partially assembled view of the electrical connector according to the present invention before assembly of the contact module.
Figure 13:
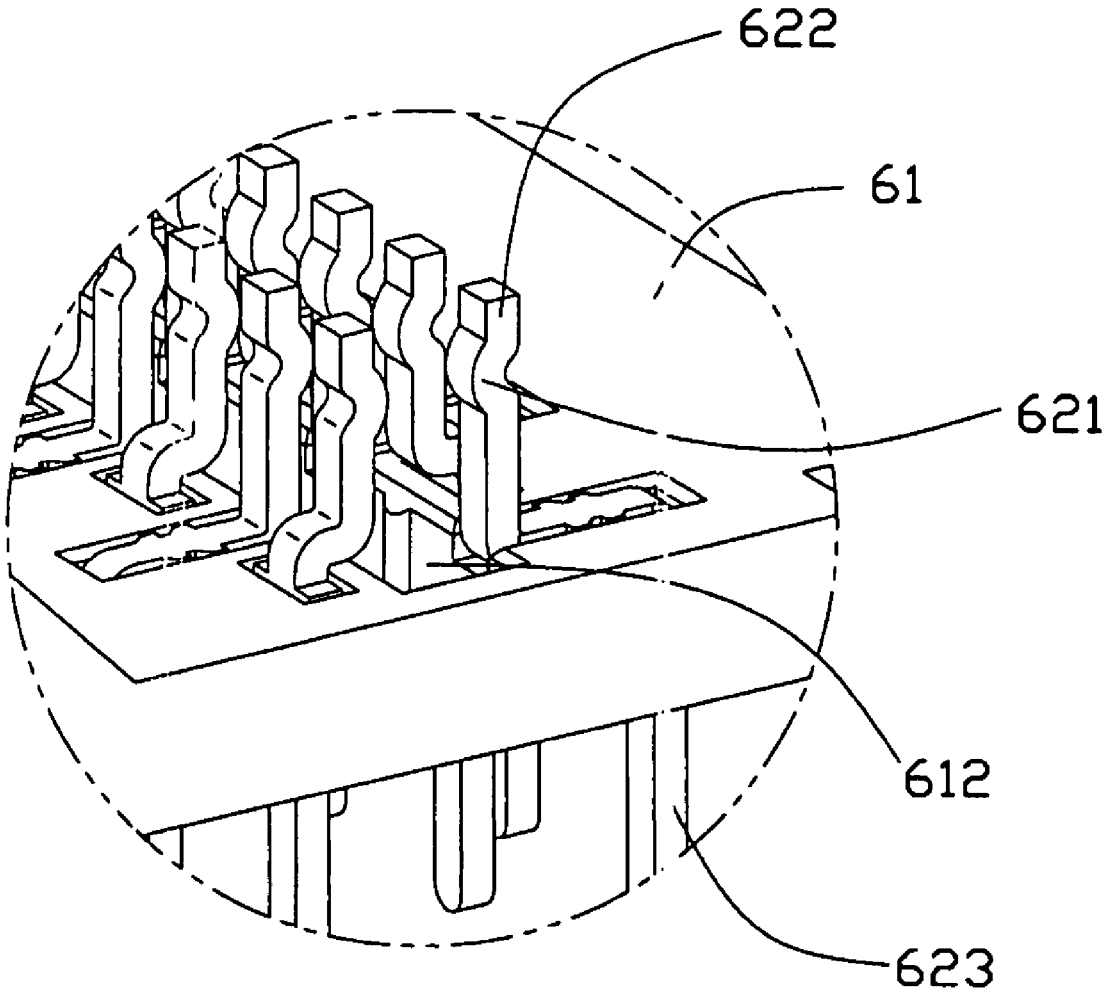
FIG. 13 is an enlarged view taken from a circled portion of FIG. 4.

Referring to FIGS. 8, 9 and 13, the connecting module 6 includes an insulator 61 and two rows of connecting terminals 62. The connecting module 6 includes a contractive portion 611 receivable in the slot 132 of the housing 1. Each connecting terminal 62 includes an arched connecting portion 621, a distal portion 622 extending upward from the connecting portion 621 and a soldering portion 623 extending outwardly from the insulator 61. In assembly, the internal PCB 4 is received in the slot 612 between the rows of the connecting terminals 62. The connecting portions 621 clamp the internal PCB 4 through deformation. As a result, the PCB 4 is firmly received in the slot 612, and wherein the connecting portions 621 touch the electric pads 42 respectively. Meanwhile, a slit 63 is formed between the PCB 4 and the distal portions 622 (seen in FIG. 9), thereby facilitating soldering tin entering into soldering area between the connecting portions 621 and the electric pads 42.

Referring to FIG. 4, the grounding member 7 is made from electric material and includes a vertical portion 711 and a first, second and third extending portions 712, 713, 714 respectively extending sideward from the vertical portion 711. The first and third extending portions 712, 714 include a first and second resilient fingers 7121, 7141 perpendicularly extending from the extending portions 712, 714, respectively. The grounding member 7 further includes a tab portion 7122 extending upwardly from the first extending portion 712 for engaging with the engaging hole 212 of the metal shield 2. The second extending portion 713 includes a pair of second resilient fingers 7131 substantially parallel to the first and third resilient fingers 7121, 7141. The first, second and third resilient fingers 7121, 7131, 7141 are extending into the cavities 101, 102 for engaging with the corresponding plugs. In particularly, the grounding member 7 touches the metal shield 2 mounted on the outer PCB, thereby forming a grounding circuit to realize a grounding purpose with insertion of corresponding plugs.

Referring to FIGS. 6 to 11, during assembly, firstly, the grounding member 7 is mounted in the housing 1 from the rear wall 15. The vertical portion 711 and the extending portions 712, 713, 714 are received in the E-shaped retaining channel 151. The first, second and third resilient fingers 7121, 7131, 7141 are extending into the cavities 101, 102 for engaging with the corresponding plugs. The tab portion 7122 extends beyond the top wall 11 of the insulative housing 1. Secondly, the pair of anti-mismating devices 5 are secured in the housing 1, wherein the main bodies 51 are abutting against the vertical portion 711 of the grounding member 7. The cantilevers 52 are extending into the cavities 101, 102 for preventing polarization. Thirdly, the couple of finished contact modules 3 are retained in the housing 1. The tongues 32 are received in the corresponding first and second openings 155, 156. The contact portions 331 of contacts 33 are extending into the cavities 101, 102. Successively, the internal PCB 4 is inserted into the slot 612 and soldered to the connecting module 6, which are fixed to the housing 1 thereafter. The contractive portion 611 is received in the slot 132 of the housing 1. The tail portions 332 are corresponding to the circuit points 41 and then being soldered theretogether. With this arrangement, the contact portions 331 are electrically connecting with the soldering portions 623 through the internal PCB 4. Finally, the metal shield 2 is covered enclosing the housing 1. The embosses 141 are fixed in the holes 241. The tab portion 7122 is engaging with the engaging hole 212. In this embodiment, the tab portion 7122 is soldered to the metal shield 2.

In use, the electrical connector 100 is mounted on the outer PCB for mating with corresponding plugs. Comparing with the prior art, the side configuration of the electrical connector 100 is trapezia shaped wherein a lower edge of the side face 22 is larger than an upper edge of the side face 22 in a plug insertion direction. In this arrangement, the electrical connector 100 has a stationary structure to prevent from being slant with insertion of the corresponding plug. Moreover, the metal shield 2 in this structure saves the material of the metal sheet.

It is to be understood, however, further though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent identify by the broad general meaning of the terms in which the appended claims are expressed.

What is claimed is:

1. An electrical connector mounted on a printed circuit board (PCB) far mating with a corresponding plug, comprising:

an insulative housing having a receiving cavity through a mating wall thereof;

a plurality of conductive contacts, each contact including a tail portion and a contact portion extending into the receiving cavity; and a metal shield enclosing the insulative housing, the metal shield defining a top face, a pair of side face extending downwardly from lateral edges of the top face, and a slant rear face, a lower edge of said side face being larger than an upper edge of the side face in a plug insertion direction;

Wherein the rear face includes a first portion and a second portion for mating with the first portion.

2. The electrical connector according to claim 1, wherein the rear face is integrally bending from the side face.

3. The electrical connector according to claim 1, wherein the first portion includes a protrusion and the second portion includes a dent for locking with the protrusion.

4. The electrical connector according to claim 1, wherein the top face forms a tab, said rear face including a projecting section with an aperture for retaining the tab, thereby consolidating the rear face with the top face.

5. The electrical connector according to claim 1, further comprising a grounding member retained in the insulative hosing and connecting with the metal shield, said grounding member including a resilient finger extending into the receiving cavity for abutting against the corresponding plug, the metal shield defining a soldering tail mounted on the PCB.

6. The electrical connector according to claim 5, wherein the top face of the metal shield defines a hole, said grounding member comprising a tab portion received in the hole, thereby connecting the grounding member with the metal shield.

7. The electrical connector according to claim 5, further comprising an anti-mismating device mounted to the insulative housing to abut against the grounding member, said anti-mismating device defining a cantilever with a hook in a distal end, the cantilever being extending into the receiving cavity for preventing incorrect connectors inserted therein.

8. The electrical connector according to claim 1, further comprising a contact module having a base portion, a tongue extending forward from the base portion, a plurality of transition terminals retained in the base portion, said conductive contacts being retained in the tongue.

9. The electrical connector according to claim 8, further comprising a connecting module and an internal PCB, the connecting module having an insulator and a plurality of connecting terminals retained in the insulator, the internal PCB including a plurality of circuit points and electric pads in communication of the circuit points, the circuit points being adapted for mating with the conductive contacts and the connecting terminals, and the electric pads electrically connecting with the transition terminals.

10. The electrical connector according to claim 1, wherein the electrical connector is a stacked modular jack connector which defines another receiving cavity stacked under said receiving cavity.

11. An electrical connector assembly comprising:

an insulative housing defining two stacked spaced first and second receiving cavities isolated from each other by a partition;

two groups of contacts disposed in said receiving cavities, respectively; and a unitary grounding member positioned on the housing and defining an long bar with first and second short spaced beams extending from two opposite ends thereof and a third short beam from a middle portion thereof thus commonly forming an upstanding E-shaped configuration; wherein the first beam defines a first resilient finger extending into an outer side of the first receiving cavity, the second beam defines a second resilient finger extending into an outer side of the second receiving cavity, while the third beam defines a pair of spaced resilient fingers respectively extending inner side of said first and second receiving cavities, located by two sides of the partition and facing the corresponding first and second resilient fingers, respectively.

12. The assembly as claimed in claim 11, wherein said grounding member is assembled to the housing forwardly and the long bar is essentially located on a rear face of the housing.

13. The assembly as claimed in claim 12, further a metallic shell encloses said housing, wherein said shell defines an oblique rear face covering the rear face of the housing so that a side face of the shell defines a trapezoid form having a right angle at a front edge thereof.

14. The assembly as claimed in claim 13, wherein a printed circuit board is located around a bottom of the housing with a rear edge of said printed circuit board approaching a bottom edge of said rear face of the shell.

15. An electrical connector mounted on a printed circuit board (PCI)) for mating with a corresponding plug, comprising:

an insulative housing having a receiving cavity through a mating wall thereof;

a plurality of conductive contacts, each contact including a tail portion and a contact portion extending into the receiving cavity; and a metal shield enclosing the insulative housing, the metal shield defining a top face, a pair of side face extending downwardly from lateral edges of the top face, and a slant rear face, a lower edge of said side face being larger than an upper edge of the side face in a plug insertion direction;

further comprising an anti-mismating device mounted to the insulative housing to abut against the grounding member, said anti-mismating device defining a cantilever with a hook in a distal end, the cantilever being extending into the receiving cavity for preventing incorrect connectors inserted therein.

16. The electrical connector as claimed in claim 15, wherein said contacts are juxtaposed with one another in a vertical direction and said tail potions are connected to an internal printed circuit board, and a plurality of conductive soldering portions connected to said internal printed circuit board to be soldered to a main printed circuit board on which the connector is mounted under a condition that said soldering portions are juxtaposed with one another in a horizontal direction.

17. The electrical connector as claimed in claim 16, wherein said internal printed circuit board is vertically received in the shield and essentially perpendicular to the plug insertion direction under a condition that the tail portions are located on one lateral side of the internal printed circuit board and the soldering portions are located on a bottom side of the internal printed circuit board.

18. The electrical connector as claimed in claim 16, wherein said internal printed circuit board is located in front of said slanted rear face.

19. The electrical connector as claimed in claim 15, wherein said top face forms a tab, said rear face including a projecting section with an aperture for retaining the tab, thereby consolidating the rear face with the top face.

20. The electrical connector as claimed in claim 15, further comprising a grounding member retained in the insulative hosing and connecting with the metal shield, said grounding member including a resilient finger extending into the receiving cavity for abutting against the corresponding plug, the metal shield defining a soldering tail mounted on the PCB, wherein the top face of the metal shield defines a hole, said grounding member comprising a tab portion received in the hole, thereby connecting the grounding member with the metal shield.

* * * * *